US010410813B1

(12) United States Patent
Ashtekar et al.

(10) Patent No.: US 10,410,813 B1
(45) Date of Patent: Sep. 10, 2019

(54) VACUUM SWITCHING APPARATUS AND ELECTRICAL CONTACT THEREFOR

(71) Applicant: EATON INTELLIGENT POWER LIMITED, Dublin (IE)

(72) Inventors: Koustubh Dnyandeo Ashtekar, Moon Township, PA (US); Steven Z. Chen, Moon Township, PA (US); Geraldo Nojima, Fort Mill, SC (US); Robert Patton Griffin, Bradfordwoods, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/944,326

(22) Filed: Apr. 3, 2018

(51) Int. Cl.
*H01H 33/664* (2006.01)

(52) U.S. Cl.
CPC ..... *H01H 33/664* (2013.01)

(58) Field of Classification Search
CPC ..... H01H 33/664; H01H 33/6642; H01H 33/6643; H01H 33/6644; H01H 1/021
USPC ..... 218/124, 123, 127, 130, 146; 200/264, 200/263, 265
See application file for complete search history.

(56) References Cited

U.S. PATENT DOCUMENTS 2,949,520 A 8/1960 Schneider
3,089,936 A 5/1963 Smith, Jr.
3,522,399 A 7/1970 Crouch
3,809,836 A 5/1974 Crouch
3,836,740 A 9/1974 Hundstad
4,109,123 A * 8/1978 Lipperts ..... H01H 33/6641 218/129
4,390,762 A 6/1983 Watzke
4,445,015 A 4/1984 Zueckler
4,553,002 A 11/1985 Slade
RE32,116 E 4/1986 Griesen
4,636,600 A 1/1987 Lipperts
4,675,482 A 6/1987 Bialkowski
4,717,797 A 1/1988 Hoene
4,806,714 A * 2/1989 Aoki ..... H01H 33/6643 218/129
4,999,463 A * 3/1991 Yin ..... H01H 33/6643 218/128
5,103,069 A * 4/1992 Yorita ..... H01H 33/6643 218/129
5,444,201 A 8/1995 Schulman et al.
5,804,788 A 9/1998 Smith
6,080,952 A 6/2000 Okutomi et al.
6,541,726 B2 * 4/2003 Schellekens ..... H01H 1/62 218/123
7,721,428 B2 5/2010 Stoving et al.
2011/0247997 A1 * 10/2011 Gentsch ..... B22F 3/12 218/146
2013/0075369 A1 * 3/2013 Li ..... H01H 33/182 218/140
2013/0091102 A1 * 4/2013 Nayak ..... G06F 3/0613 707/692

* cited by examiner

*Primary Examiner* — Truc T Nguyen
*Assistant Examiner* — William A Bolton
(74) *Attorney, Agent, or Firm* — Eckert Seamans Cherin & Mellott, LLC

(57) ABSTRACT

An electrical contact is for a vacuum switching apparatus. The electrical contact includes a hub portion and a plurality of petal portions extending radially outwardly from the hub portion. The electrical contact is made from conductive materials and insulating materials.

18 Claims, 10 Drawing Sheets

VACUUM SWITCHING APPARATUS AND ELECTRICAL CONTACT THEREFOR

BACKGROUND

Field

The disclosed concept relates generally to vacuum switching apparatus such as, for example, vacuum interrupters. The disclosed concept also relates to electrical contacts for vacuum switching apparatus.

Background Information

Vacuum switching apparatus such as, for example, vacuum interrupters, include separable main contacts located within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections.

Some known vacuum interrupters include a radial magnetic field (also known as a Transverse Magnetic Field, or TMF) generating mechanism such as, for example and without limitation, a spiral electrical contact or a contrate cup, designed to force rotation of the arc column between the pair of spiral contacts interrupting a high current, thereby spreading the arcing duty over a relatively wide area. FIG. 1, for example, shows one such prior art vacuum switching apparatus (e.g., vacuum interrupter 2). The vacuum interrupter 2 includes electrode stems 4,6 and spiral contacts 14,16 each coupled to a corresponding one of the electrode stems 4,6. As shown in FIG. 2, the entire spiral contact 14 is made of a single piece of material. Vacuum interrupters of the type just described suffer from a number of disadvantages. For example, existing vacuum interrupters that interrupt DC current typically are forced to rely on inverters due to the high current levels involved and will interrupt only when the contacts experience an artificially created 'current zero (CZ)' state within the circuit, as is known by those skilled in the art. Some DC interrupters are also associated with external apparatuses that generate magnetic field outside the vacuum interrupter for magnetic field blowout type arc quenching. Additionally, existing spiral contacts typically have relatively limited longevity due to excessive heating of the arms of the spiral contacts during current interruption. Furthermore, the arms of existing spiral contacts commonly have sharp edges. As a result, during current interruption this frequently causes restrike of the spiral contacts, or, causes them to bounce off of each other, thus further limiting the longevity of the spiral contacts.

There is thus room for improvement in vacuum switching apparatus and in electrical contacts therefor.

SUMMARY

These needs and others are met by embodiments of the disclosed concept, which are directed to a vacuum switching apparatus and electrical contact therefor.

As one aspect of the disclosed concept, a electrical contact is provided for a vacuum switching apparatus. The electrical contact includes a hub portion and a plurality of petal portions extending radially outwardly from the hub portion. The electrical contact is made from conductive materials and insulating materials.

As another aspect of the disclosed concept, a vacuum switching apparatus is provided. The vacuum switching apparatus includes a first electrical contact and a second electrical contact configured to move into and out of engagement with the first electrical contact. At least one of the first electrical contact and the second electrical contact includes a hub portion and a plurality of petal portions extending radially outwardly from the hub portion, and is made from conductive materials and insulating materials.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Example 1

Figure 3:
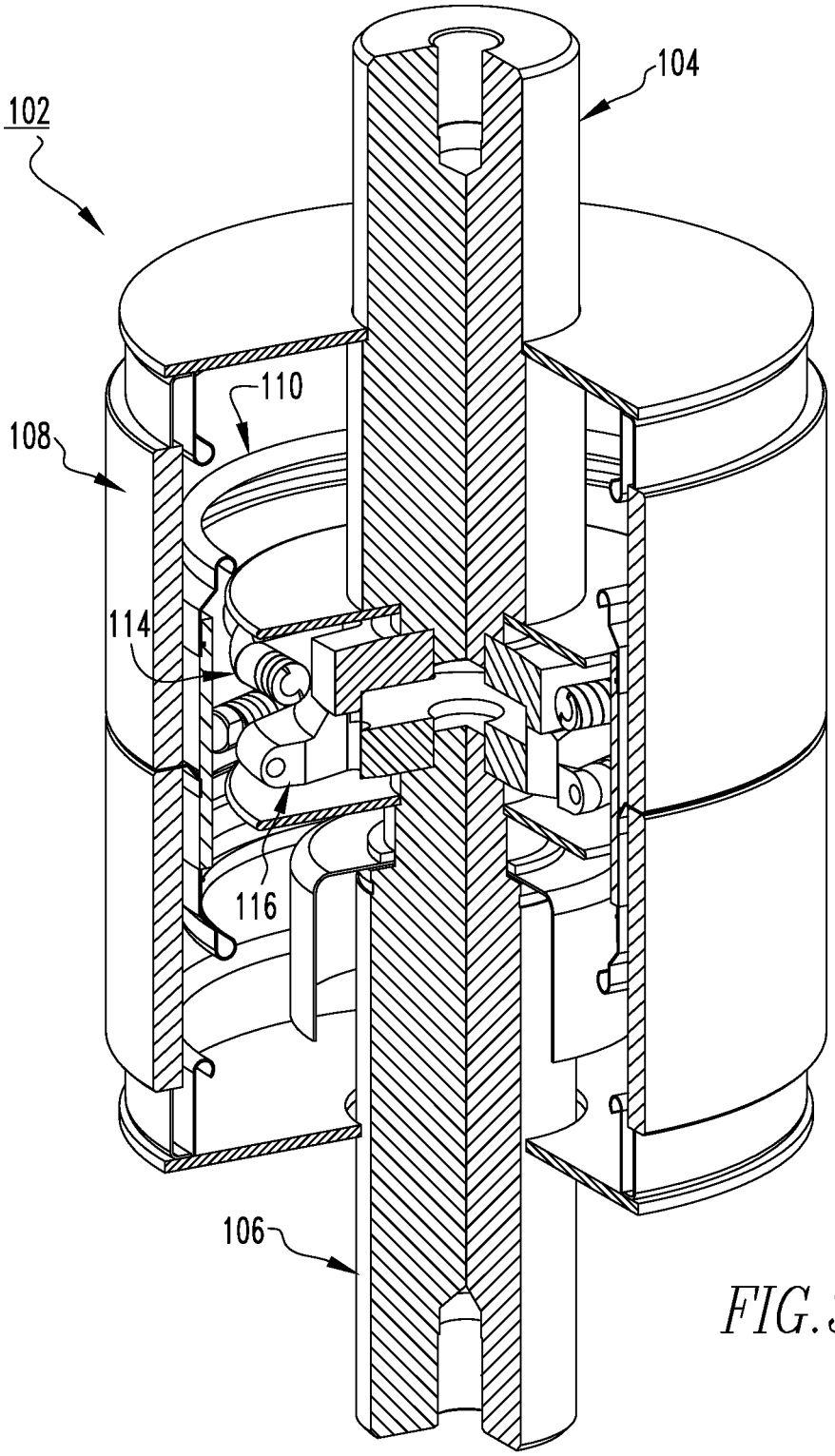
FIG. 3 is an isometric, partially cutaway view of a vacuum switching apparatus and electrical contact therefor, in accordance with one non-limiting embodiment of the disclosed concept.

FIG. 3 is an isometric, partially cutaway view of a vacuum switching apparatus (e.g., without limitation, vacuum interrupter 102), in accordance with one non-limiting embodiment of the disclosed concept. The vacuum interrupter 102 includes a pair of electrode stems 104,106, a tubular ceramic member 108, a tubular vapor shield 110 located internal the ceramic member 108, and a pair of novel electrical contacts (e.g., without limitation spiral contacts 114,116) each located internal the vapor shield 110 and coupled to a corresponding one of the electrode stems 104,106. In operation, the spiral contacts 114,116 move into and out of engagement with each other in order to connect and disconnect power in the electrical circuit, respectively. As will be discussed in greater detail below, the spiral contacts 114,116 are configured so as to quench an electrical arc formed between the spiral contacts 114,116 during current interruption in a significantly more efficient manner than the spiral contacts 14,16 (FIG. 1).

Figure 4:
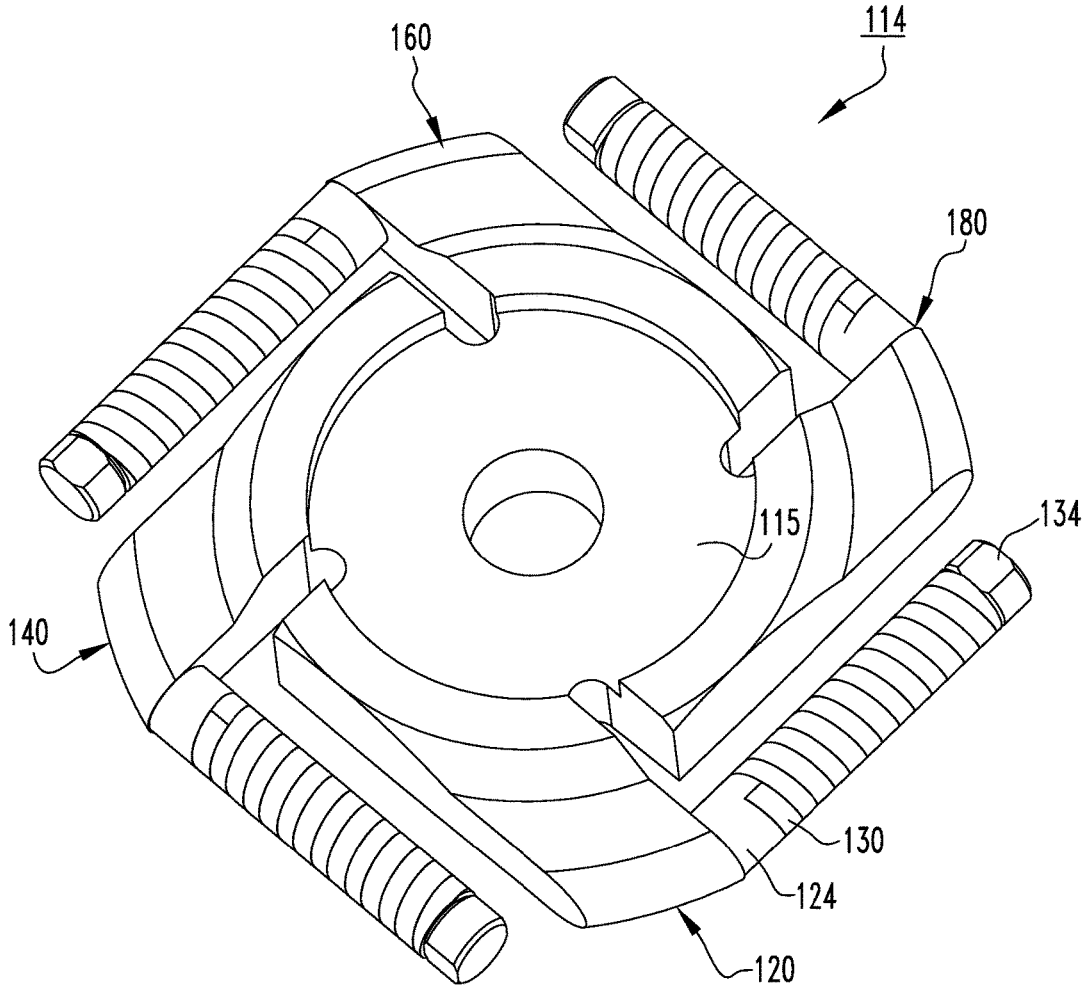
FIG. 4 is an isometric view of one of the electrical contacts of FIG. 3.
Figure 5:
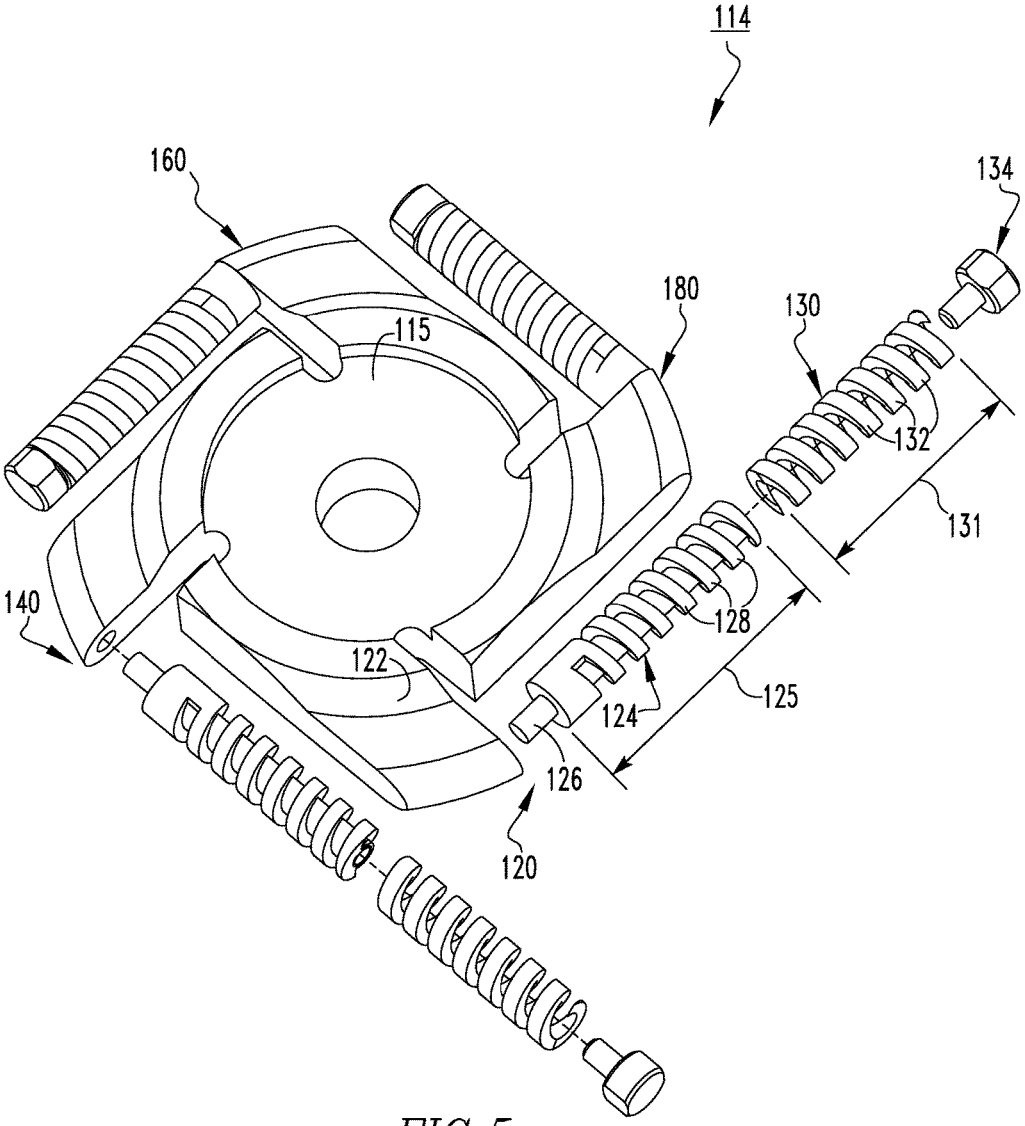
FIG. 5 is a partially exploded isometric view of the electrical contact of FIG. 4.

For ease of illustration and economy of disclosure, only the spiral contact 114 will be discussed in greater detail herein, although it will be appreciated that the spiral contact 116 is substantially the same as the spiral contact 114. FIGS. 4 and 5 show isometric and partially exploded isometric views, respectively, of the spiral contact 114. As shown in FIG. 5, the spiral contact 114 includes a hub portion 115 and a plurality of petal portions 120,140,160,180 each extending radially outwardly from the hub portion 115. In one example embodiment, each of the petal portions 120,140,160,180 is substantially the same. However, for ease of illustration and economy of disclosure, only the petal portion 120 will be discussed in detail herein.

The petal portion 120 includes an extension portion 122, a shaft member 124, a quenching member 130, and preferably includes a locking member (e.g., without limitation, bolt 134). The shaft member 124, the quenching member 130, and the bolt 134 are each separate and distinct components from the extension portion 122 and the hub portion 115. The extension portion 122 extends from the hub portion 115 and is preferably integral therewith. The shaft member 124 has a coupling portion 126 that is coupled to the extension portion 122 and, in one optional embodiment, is located substantially perpendicular to the extension portion 122. The shaft member 124 may be coupled to the extension portion 122 by any suitable mechanism known in the art (e.g., without limitation, being threadably coupled, being brazed, being crimped to the extension portion 122, and being thermally bonded to the extension portion 122 and machined to a final shape). As shown, the shaft member 124 has a plurality of threads 128. Similarly, the quenching member 130 has a plurality of threads 132 that generally encircle an axis passing through the quenching member 130. When assembled, the threads 128 of the shaft member 124 are threadably coupled to the threads 132 of the quenching member 130. Furthermore, in one example embodiment, when the quenching member 130 is coupled (i.e., threadably coupled) to the shaft member 124, the shaft member 124 extends through the quenching member 130. In order to prevent the quenching member 130 from being de-coupled from the shaft member 124 during interruption, the bolt 134 extends into and is coupled to an end portion of the shaft member 124.

Figure 1:
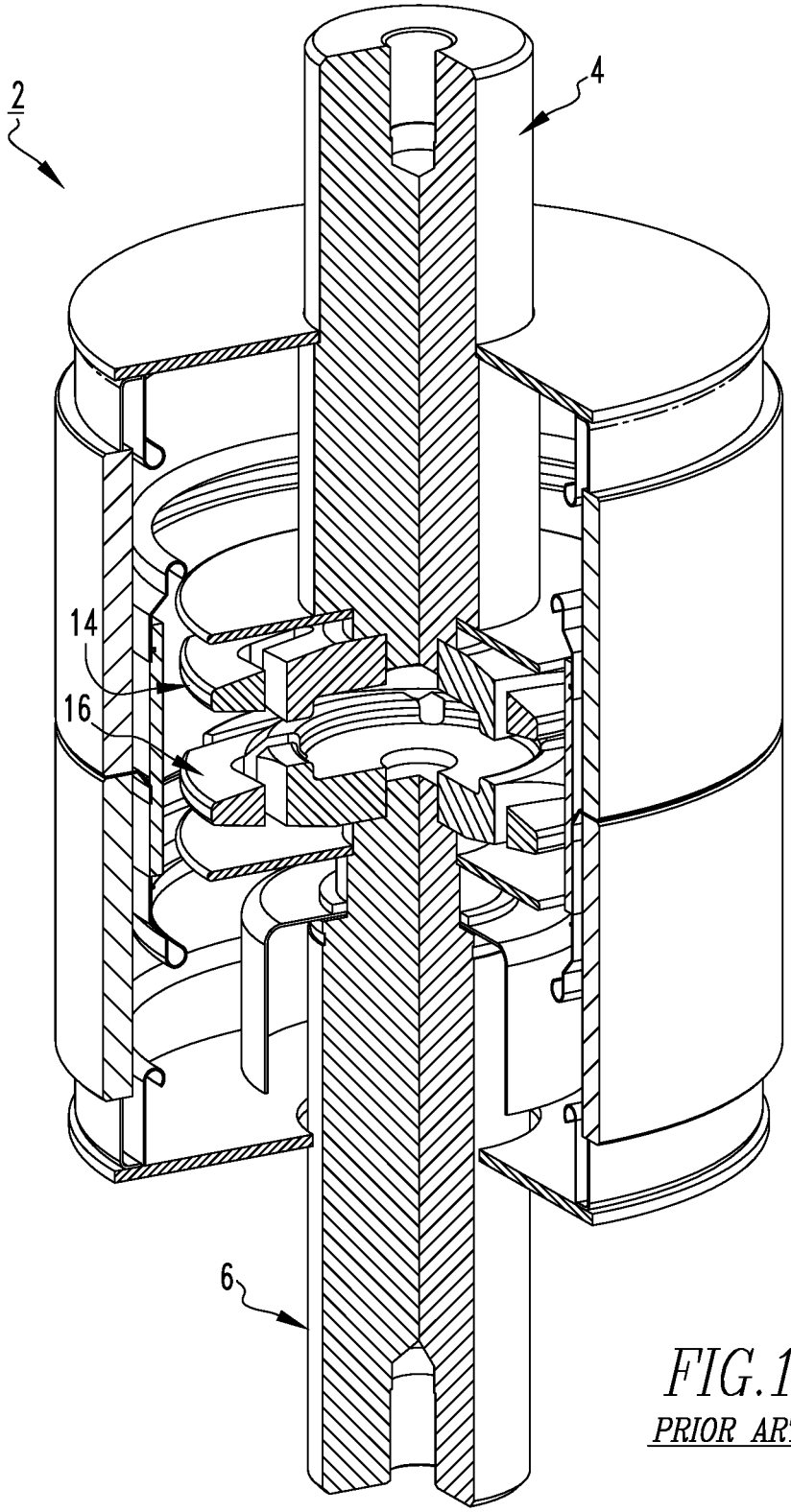
FIG.1 PRIOR ART
FIG. 1 is an isometric, partially cutaway view of a prior art vacuum switching apparatus and electrical contact therefor.
Figure 2:
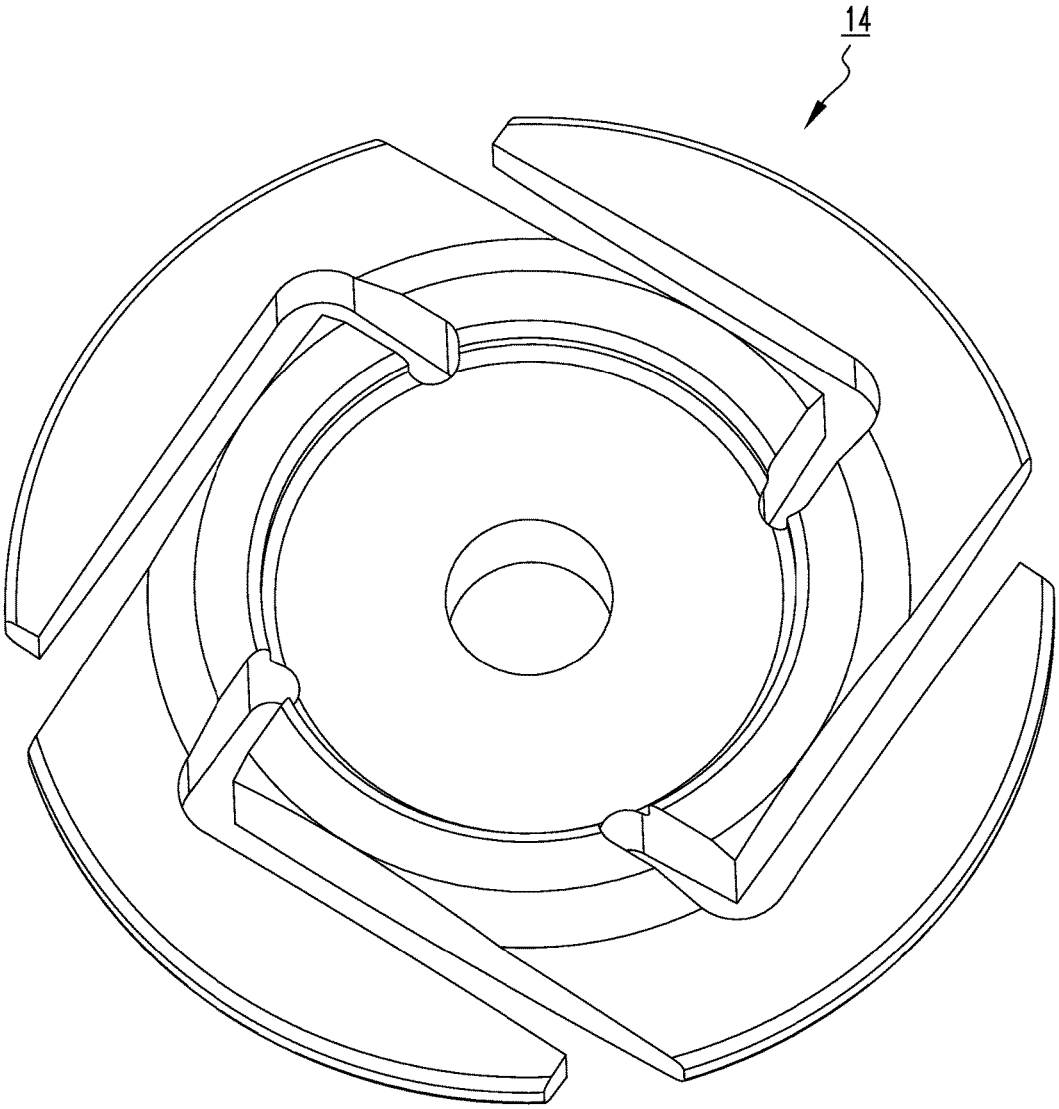
FIG.2 PRIOR ART
FIG. 2 is an isometric view of the electrical contact of FIG. 1.

As discussed above, the spiral contact 114 is configured so as to quench an electrical arc in a significantly more efficient manner than the spiral contacts 14,16 (FIG. 1). In order to achieve this desirable benefit, the spiral contact 114 is made from both a conductive material and an insulating material. The insulating material may be, for example and without limitation, alumina, porcelain, or epoxy. The conductive materials may be, for example and without limitation, a copper chromium alloy, a pure or alloyed copper, silver, a refractory metal such as Tungsten, Zirconium, Hafnium, lanthanides, and/or any alloys of above conductive materials containing outside elements (e.g., without limitation, Lanthanum hexaboride (LaB6). In one exemplary embodiment, at least one of the plurality of petal portions 120,140,160,180, and preferably each of the plurality of petal portions 120,140,160,180, is made of the conductive material and the insulating material. In the exemplary embodiment, the hub portion 115 and the extension portions 122 of each of the petal portions 120,140,160,180 form a unitary component made from a single piece of the conductive material. Additionally, the shaft member 124 is preferably made of the conductive material, the quenching member 130 is preferably made of the insulating material, and the bolt 134 is made of any suitable material known in the art.

Accordingly, during current interruption, the resultant electrical arc is forced radially outwardly along the petal portions 120,140,160,180 of the spiral contact 114. When the electrical arc begins to fully pass the extension portion 122, the electrical arc experiences resistance. Specifically, a portion of the electrical arc smoothly passes from the extension portion 122 to the shaft member 124. However, as the electrical arc continues to progress radially outwardly along spiral path of the shaft member 124, and as the quenching member 130 is constantly engaging the shaft member 124, the electrical arc will be constantly quenched as it passes radially outward over the quenching member 130.

In one example embodiment the shaft member 124 has a first length 125 and the quenching member 130 has a second length 131 substantially the same as the first length 125. Thus, as the quenching member 130 is made of the insulating material, the electrical arc root, which is traveling from the extension portion 122, will attach to the cylindrical portion of the shaft member 124. Consequently, the arc root will attempt to continue to travel on the threads in a spirally outward direction. However, the insulating threads 132 of the insulating member 130 will provide resistance to the arc root travel. The arc root will not travel smoothly radially outwardly, but rather will be inhibited in a corkscrew manner along all of the threads 132 of the quenching member 130. This quenching imparted to the electrical arc by the quenching member 130 results in several significant advantages.

The contemporary vacuum interrupter designs cannot interrupt the current if the current does not pass through zero value, or 'current zero (CZ)' state. First, as discussed above, existing vacuum interrupters that interrupt DC current typically are forced to rely on inverters and related power electronic components to artificially generate such current zero event or external associated apparatus to generate magnetic field blowout. However, in accordance with the disclosed concept, the spiral contacts 114,116 advantageously allow the for interruption of DC current without the need to rely on an inverter, thus providing for a more versatile vacuum interrupter that does not require an excess component of a vacuum interrupter. Specifically, by passing through the quenching member 130, current will be able to achieve a zero current event. At this level, interruption without an inverter becomes achievable. Second, the spiral contacts 114,116 are advantageously able to be used for significantly longer cycles of operation than existing spiral contacts (e.g., the spiral contacts 14,16, shown in FIG. 1). That is, the petal portions 120,140,160,180 of the spiral contact 114 are able to be cooled down due to limited arc root presence on them because of the quenching members 130 during interruption, thus minimizing overheating, a significant factor that limits the longevity of spiral contacts. Finally, it will be appreciated that the assembled shaft member 124 and quenching member 130 advantageously has relatively minimal sharp edges. As a result, during current interruption the likelihood of restrike, another factor limiting longevity of spiral contacts, is relatively small, as compared with prior art spiral contacts.

Figure 6:
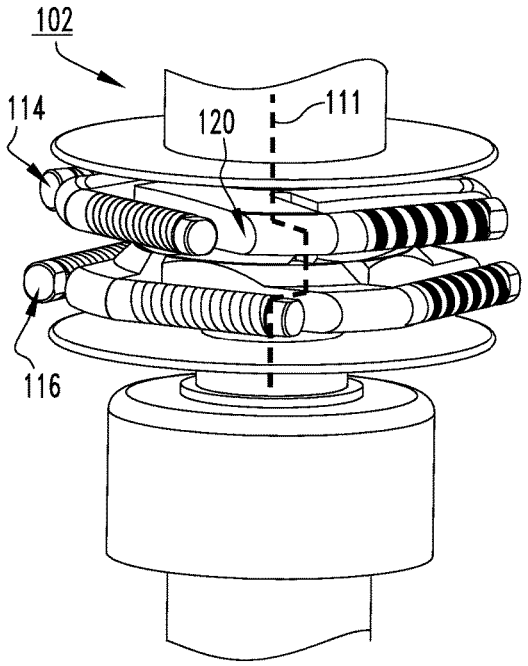
FIGS. 6-9 are isometric views of portions of the vacuum switching apparatus of FIG. 3, shown at different stages as the electrical contacts move from a closed position to an open position.
Figure 7:
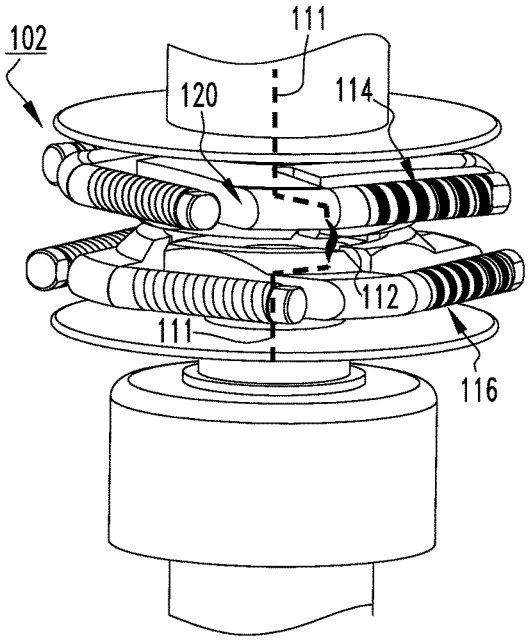
Figure 8:
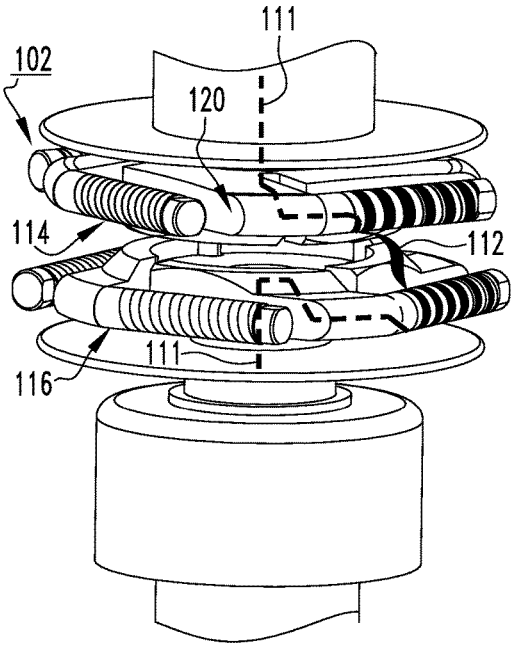
Figure 9:
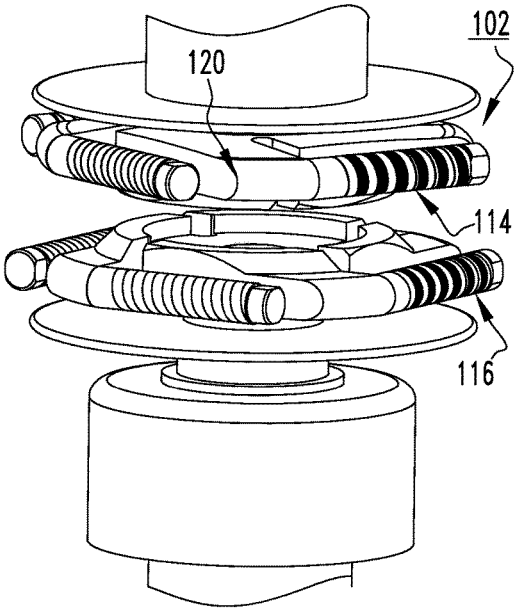

The effectiveness of the quenching of the electrical arc will now be discussed in connection with FIGS. 6-9, which each show portions of the vacuum interrupter 102 at different stages during current interruption. When the spiral contacts 114,116 are closed, as shown in FIG. 6, current flows through both spiral contacts 114,116 (see, for example, dashed line 111, denoting current flow). When the spiral contacts 114,116 initially begin to open, as shown in FIG. 7, an electrical arc (see, for example, arc 112) is initially formed across the gap between the spiral contacts 114,116 (e.g., on extension portion 122). As the spiral contacts 114,116 continue to open, as shown in FIG. 8, the arc 112 formed across the gap between the spiral contacts 114,116 moves radially outward and reaches the petal portions (only one petal portion 120 is indicated). When the arc 112 reaches the petal portions 120, the quenching member 130 (shown but not indicated) stretches the arc as well as weakens it. As such, once the spiral contacts 114,116 are fully opened, as shown in FIG. 9, the electrical arc has advantageously been extinguished by the quenching members 130.

Figure 10:
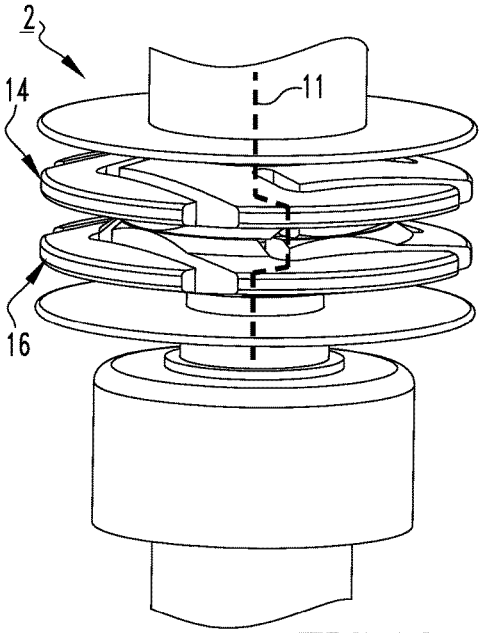
FIG.10 PRIOR ART
FIGS. 10-13 are isometric views of portions of the prior art vacuum switching apparatus of FIG. 1, shown at different stages as the electrical contacts move from a closed position to an open position.
Figure 11:
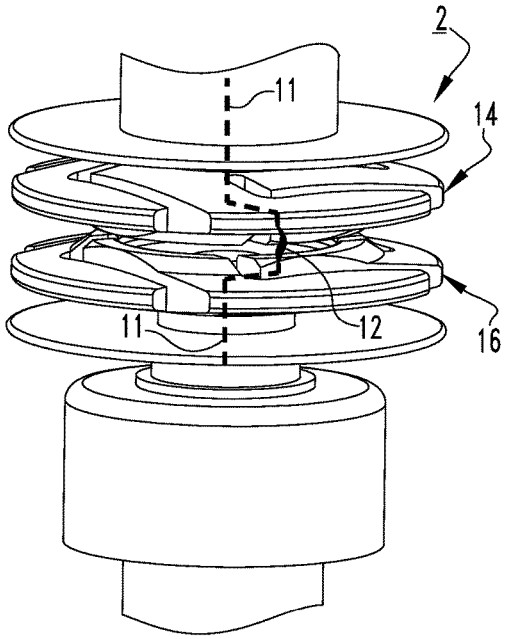
FIG.11 PRIOR ART
Figure 12:
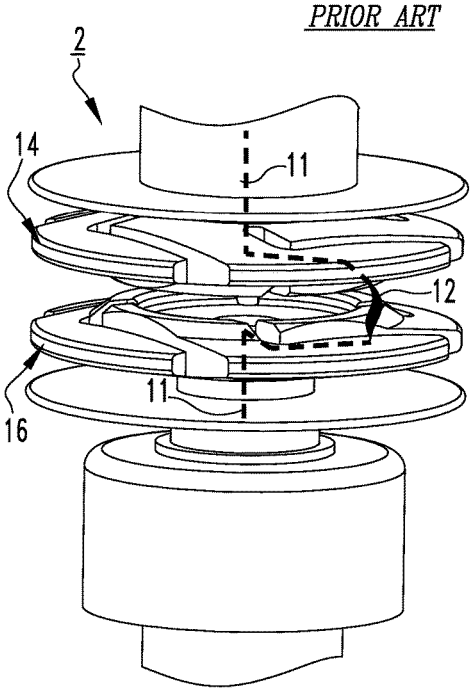
FIG.12 PRIOR ART
Figure 13:
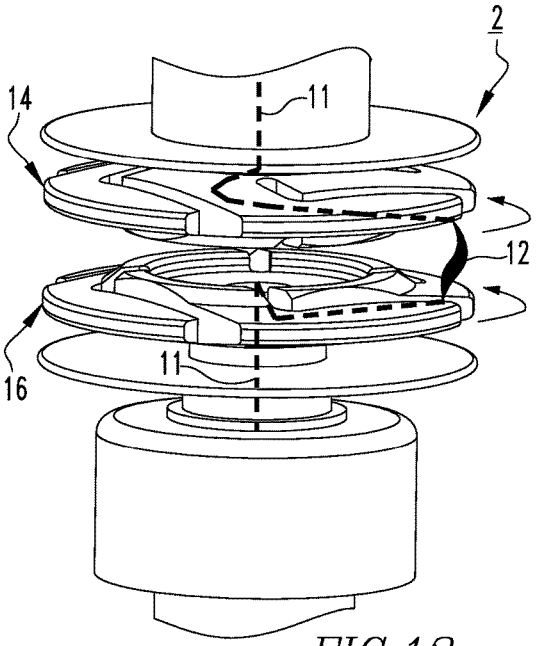
FIG.13 PRIOR ART

Compare, for example, FIGS. 10-13, which show portions of the prior art vacuum interrupter 2 at different stages during current interruption. When the spiral contacts 14,16 are closed, as shown in FIG. 10, current, represented by dashed line 11, flows through both of the spiral contacts 14,16. As the spiral contacts 14,16 are initially opened, as shown in FIG. 11, an electrical arc 12 is initially formed across the gap between the spiral contacts 14,16. As the spiral contacts 14,16 continue to open, as shown in FIG. 12, the arc 12 formed across the gap between the spiral contacts 14,16 moves radially outward and starts to rotate with respect to the central axis along the petal portions of the spiral contacts 14,16. Finally, when the spiral contacts 14,16 are fully open, as shown in FIG. 13, the arc 12 has still not been extinguished and is still swirling around the central axis, looking for the current zero event for the extinguishing the arc. It will thus be appreciated that the spiral contacts 114,116 (FIGS. 6-9) provide a significantly more effective mechanism to extinguish and/or quench an electrical arc formed during current interruption.

Example 2

Figure 14:
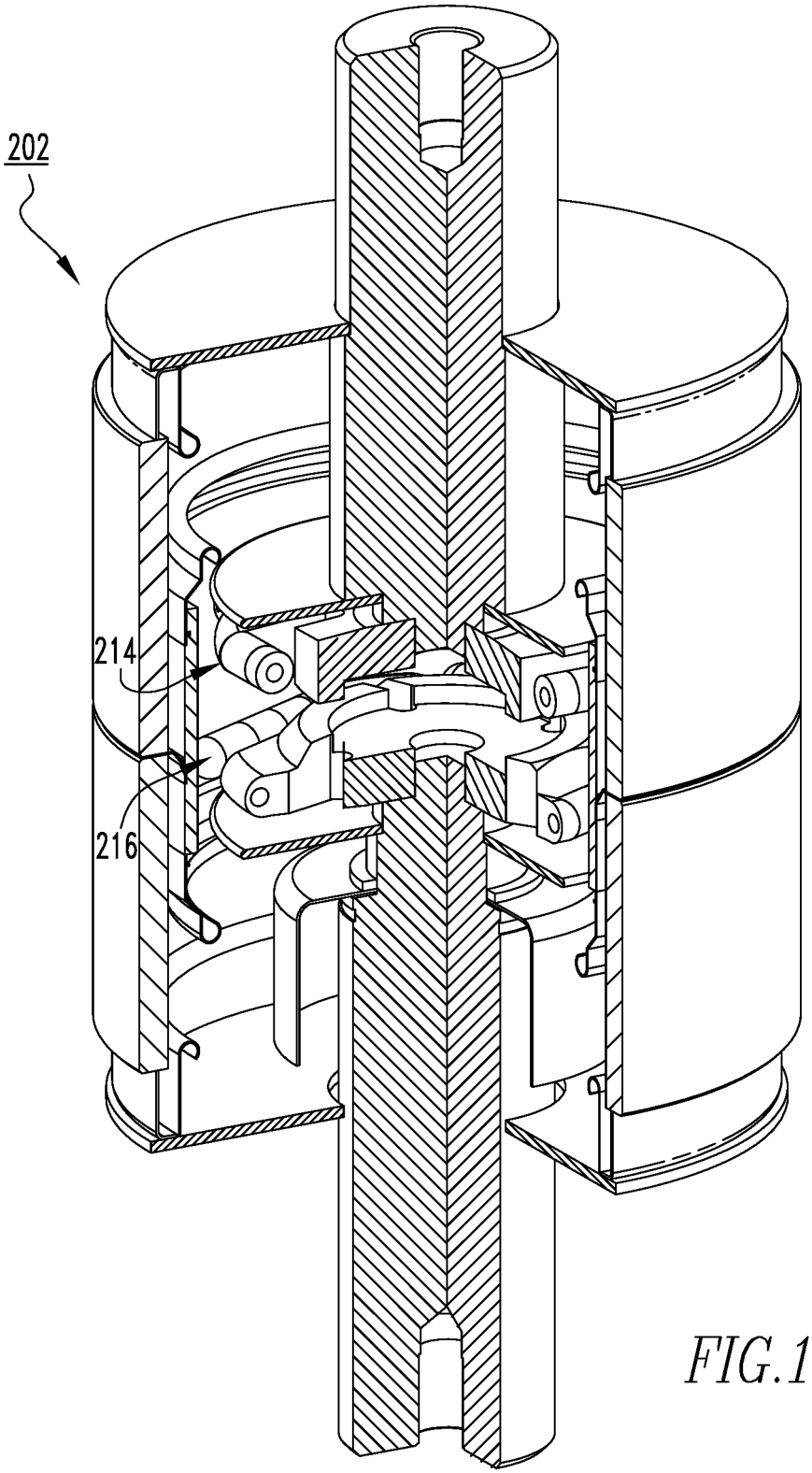
FIG. 14 is an isometric, partially cutaway view of another vacuum switching apparatus and electrical contact therefor, in accordance with another non-limiting embodiment of the disclosed concept.
Figure 15:
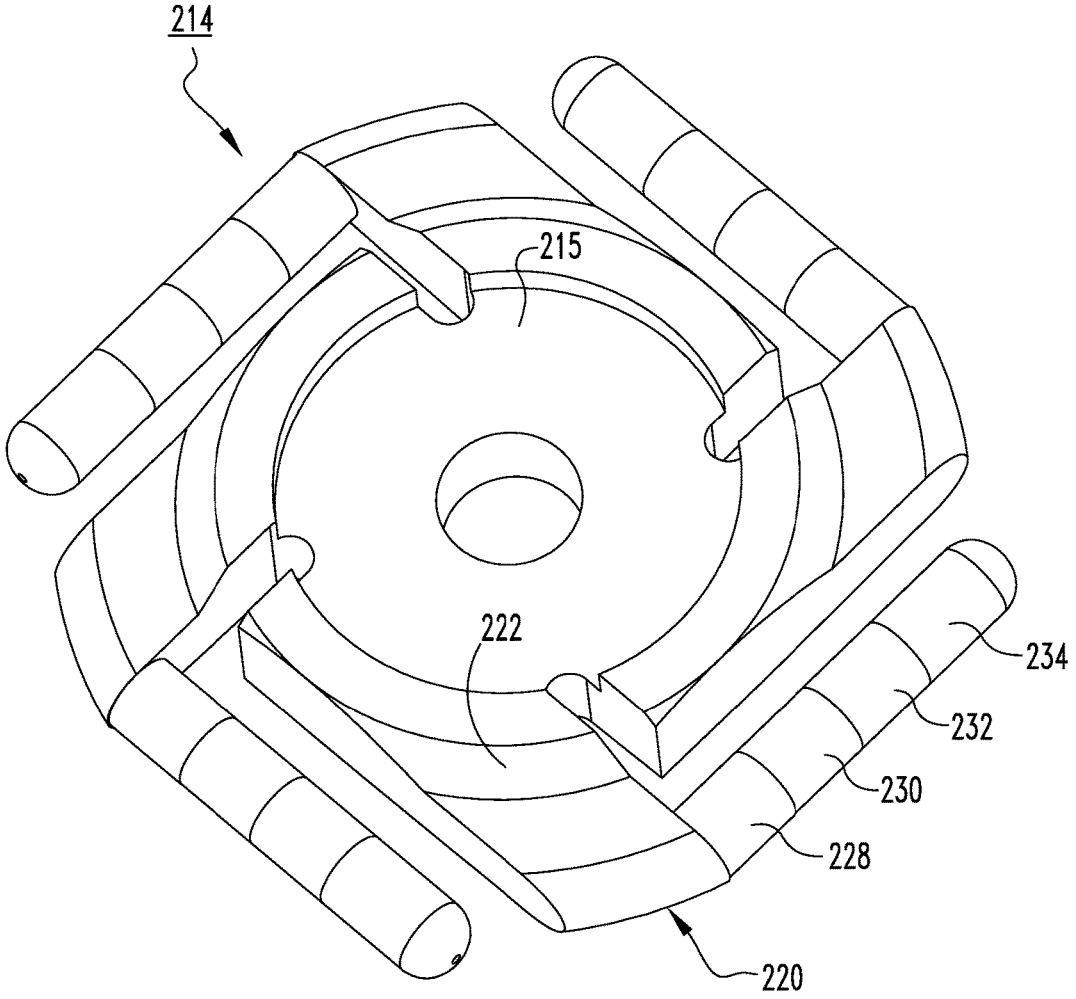
FIG. 15 is an isometric view of one of the electrical contacts of FIG. 14.
Figure 16:
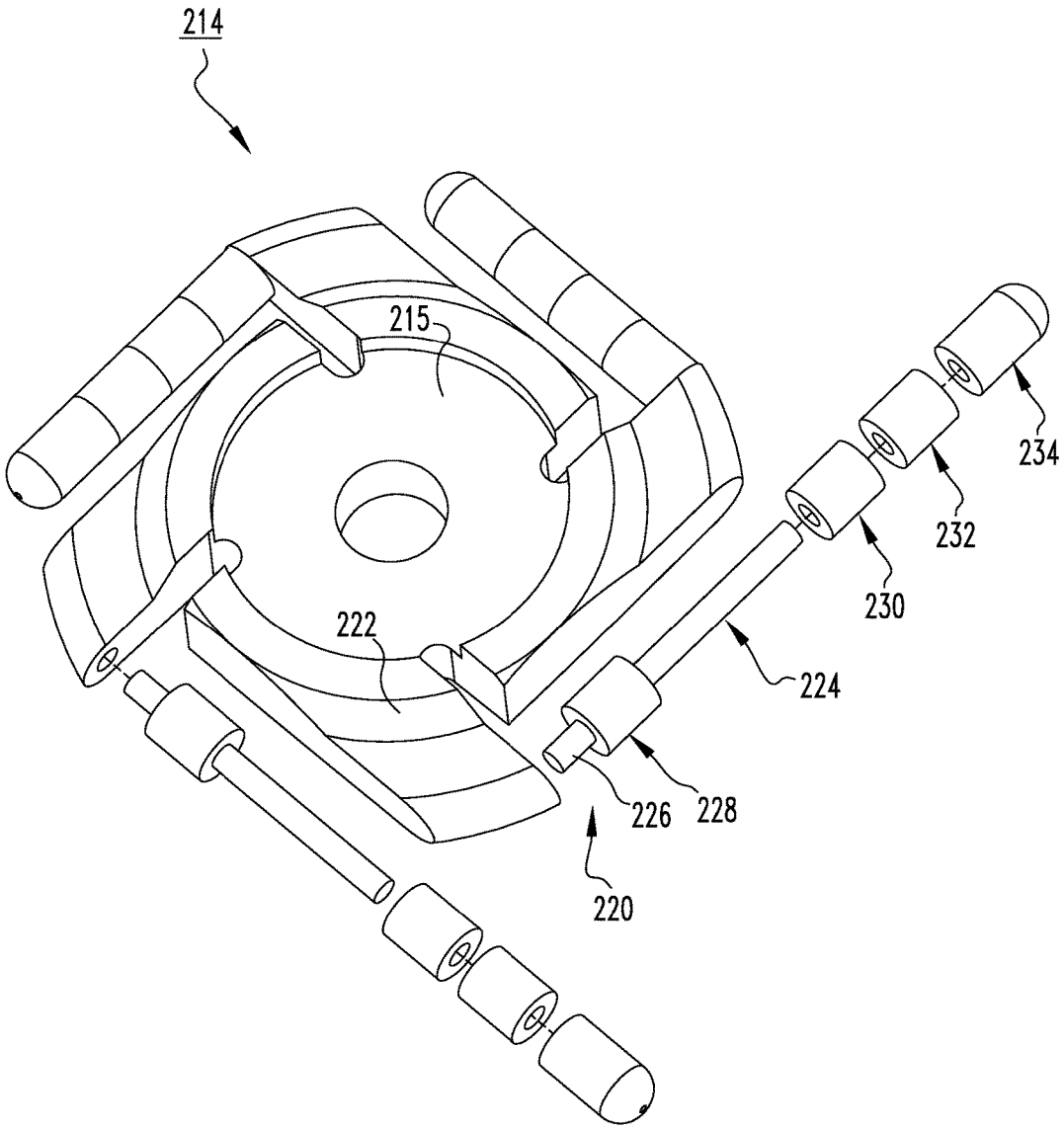
FIG. 16 is a partially exploded isometric view of the electrical contact of FIG. 15.

FIG. 14 shows another example vacuum switching apparatus (e.g., without limitation, vacuum interrupter 202). The vacuum interrupter 202 is substantially the same as the vacuum interrupter 102, but includes differently structured spiral contacts 214,216. FIGS. 15 and 16 show isometric and partially exploded isometric views, respectively, of the spiral contact 214. As shown in FIG. 16, the petal portion 220 includes the shaft member 224, a number of insert members 228,232, and a number of quenching members 230,234. The shaft member 224 is coupled to the extension portion 222 by any suitable mechanism known in the art (e.g., without limitation, being threadably coupled, being brazed). Furthermore, as shown, the shaft member 224 extends through the insert members 228,232 and the quenching member 230, and at least partially through the quenching member 234. The insert members 228,232 and the quenching members 230,234 may be coupled to the shaft member 224 by any suitable mechanism known in the art (e.g., without limitation, being threadably coupled, being brazed). It is also within the scope of the disclosed concept for any one of the insert members 228,232 and the quenching members 230, 234 to instead be loosely maintained on the shaft member 224. In one example embodiment, the insert members 228, 232 are made of the conductive material and the quenching members 230,234 are made of the insulating material.

As such, it will be appreciated that the spiral contact 214 provides substantially similar advantages to the vacuum interrupter 202 (i.e., in terms of arc quenching) as the spiral contact 114 provides to the vacuum interrupter 102. That is, as the electrical arc moves radially outwardly from the hub portion 215 toward the end of the petal portion 220, the arc passes over the quenching members 230,234. However, rather than quenching in a corkscrew motion, as done by the quenching member 130 (FIG. 5), the quenching members 230,234 provide for a step-wise quenching attempt as the arc moves radially outwardly along the petal portions 220. That is, the arc will pass smoothly from the extension portion 222 to the first insert member 228, be at least attempted to be quenched by the first quenching member 230, then pass to and smoothly pass over the second insert member 232, and then pass to the second quenching member 234.

Thus, the momentum and energy of the electrical arc is broken up in a step-wise quenching attempt, or chopping manner, wherein the arc experiences significantly large amounts of resistance when passing through the quenching members 230,234, and lesser amounts of resistance when passing through the interspersed insert members 228,232. Furthermore, as the shaft member 224 extends through or at least partially into each of the insert members 228,232 and the quenching members 230,234, these step-wise quenching attempts are permissible. Specifically, it will be appreciated that when the current is radially at locations on the shaft member 224 corresponding to the insert members 228,232, there will be relatively little if any electrical resistance, whereas when the current is at locations on the shaft member 224 corresponding to the quenching members 230,234, there will be significant electrical resistance. Accordingly, substantially all of the advantages discussed above provided to the vacuum interrupter 102 by the spiral contacts 114,116 likewise apply to the vacuum interrupter 202, except that the quenching attempts are performed in a more step-wise quenching attempt, rather than corkscrew, manner. As a result, the arc gets quenched in a "digital manner" wherein the quenching members 230,234 provide attempts to quench the arc. That is, if quenching member 230 fails to quench the arc, quenching member 234 attempts to do the same.

While the disclosed concept has been described herein in association with the spiral contacts 114,116,214,216, it will be appreciated that suitable alternative spiral contacts are contemplated herein. Specifically, it is contemplated that arc quenching can be controlled and performed herein by providing a spiral contact with any suitable quenching member in order to resist current flow as the current flows radially outwardly along petal portions of the spiral contact. That is, the quenching members 130,230,234 are exemplary only, and suitable alternative quenching members could have any suitable alternative geometry, configuration, and be employed in any number and/or combination in order to effectively quench an electrical arc.

Accordingly, it will be appreciated that disclosed concept provides for an improved (e.g., without limitation, more versatile, better able to extinguish an electrical arc) vacuum switching apparatus 102,202 and spiral contact 114,116,214,216 therefor, in which the spiral contacts 114,116,214,216 are made from a conductive material and an insulating material.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical contact for a vacuum switching apparatus, said electrical contact comprising:

a hub portion; and a plurality of petal portions extending radially outwardly from said hub portion, wherein said electrical contact is a spiral contact; and wherein at least one of said plurality of petal portions is made from conductive materials and insulating materials.

2. The electrical contact of claim 1 wherein all of said plurality of petal portions are made from conductive materials and insulating materials.

3. The electrical contact of claim 2 wherein each petal portion comprises an extension portion, a shaft member coupled to said extension portion, and a quenching member coupled to said shaft member; wherein said extension portion extends from said hub portion; wherein said shaft member is made from conductive materials; and wherein the quenching member is made from insulating materials.

4. The electrical contact of claim 3 wherein said shaft member is coupled to said extension portion by a mechanism selected from the group consisting of being threadably coupled to said extension portion, being brazed to said extension portion, being crimped to said extension portion, and being thermally bonded to said extension portion and machined to a final shape.

5. The electrical contact of claim 3 wherein said shaft member is disposed substantially perpendicular to said extension portion.

6. The electrical contact of claim 3 wherein said shaft member and said quenching member are each separate and distinct components from said extension portion.

7. The electrical contact of claim 3 wherein said shaft member extends through said quenching member; and wherein said quenching member is threadably coupled to said shaft member.

8. The electrical contact of claim 7 wherein each petal portion further comprises a locking member coupled to said shaft member in order to prevent said quenching member from being de-coupled from said shaft member.

9. The electrical contact of claim 7 wherein said shaft member has a first length; and wherein said quenching member has a second length substantially the same as the first length.

10. The electrical contact of claim 3 wherein each petal portion further comprises an insert member made from the conductive material; and wherein said shaft member extends through said quenching member and said insert member.

11. The electrical contact of claim 10 wherein said quenching member and said insert member are threadably coupled to said shaft member.

12. The electrical contact of claim 10 wherein each petal portion further comprises another quenching member and another insert member; wherein said another quenching member is made from insulating materials; wherein said another insert member is made from conductive materials; and wherein said shaft member extends at least partially through said another quenching member and said another insert member.

13. The electrical contact of claim 1 wherein the insulating materials are selected from the group consisting of alumina, porcelain, and epoxy.

14. A vacuum switching apparatus comprising:

a first electrical contact; and a second electrical contact configured to move into and out of engagement with said first electrical contact, wherein at least one of said first electrical contact and said second electrical contact comprises:

a hub portion, and a plurality of petal portions extending radially outwardly from said hub portion, wherein said at least one of said first electrical contact and said second electrical contact is made from conductive materials and insulating materials, wherein each said first electrical contact and said second electrical contact are electrical contacts; wherein each of said plurality of petal portions comprises an extension portion, a shaft member coupled to said extension portion, and a quenching member coupled to said shaft member; wherein said extension portion extends from said hub portion; wherein said shaft member is made from conductive materials; and wherein the quenching member is made from insulating materials.

15. The vacuum switching apparatus of claim 14 wherein both of said first electrical contact and said second electrical contact comprise:

a hub portion, and a plurality of petal portions extending radially outwardly from said hub portion, wherein both of said first electrical contact and said second electrical contact are made from conductive materials and insulating materials.

16. The vacuum switching apparatus of claim 14 wherein said vacuum switching apparatus is a vacuum interrupter.

17. The vacuum switching apparatus of claim 14 wherein said shaft member extends through said quenching member; and wherein said quenching member is threadably coupled to said shaft member.

18. The vacuum switching apparatus of claim 14 wherein each petal portion further comprises an insert member made from conductive materials; and wherein said shaft member extends through said quenching member and said insert member.

* * * * *